US008110117B2

(12) United States Patent
Wang et al.

(10) Patent No.: US 8,110,117 B2
(45) Date of Patent: Feb. 7, 2012

(54) METHOD TO FORM A RECESS FOR A MICROFLUIDIC DEVICE

(75) Inventors: Fuchao Wang, Plano, TX (US); Ming Fang, Plano, TX (US)

(73) Assignee: STMicroelectronics, Inc., Coppell, TX (US)

( * ) Notice: Subject to any disclaimer, the term of this patent is extended or adjusted under 35 U.S.C. 154(b) by 247 days.

(21) Appl. No.: 12/422,732

(22) Filed: Apr. 13, 2009

(65) Prior Publication Data

US 2010/0163517 A1 Jul. 1, 2010

Related U.S. Application Data

(60) Provisional application No. 61/142,157, filed on Dec. 31, 2008.

(51) Int. Cl.
*B44C 1/22* (2006.01)

(52) U.S. Cl. ..... 216/2; 216/27; 216/39

(58) Field of Classification Search ..... None
See application file for complete search history.

(56) References Cited

U.S. PATENT DOCUMENTS

| | | | | |
|---|---|---|---|---|
| 6,209,989 | B1 * | 4/2001 | Silverbrook | 347/54 |
| 6,245,247 | B1 * | 6/2001 | Silverbrook | 216/27 |
| 6,247,791 | B1 * | 6/2001 | Silverbrook | 347/54 |
| 6,312,107 | B1 * | 11/2001 | Silverbrook | 347/54 |
| 6,331,258 | B1 * | 12/2001 | Silverbrook | 216/27 |
| 6,331,259 | B1 * | 12/2001 | Ozaki et al. | 216/27 |
| 6,336,710 | B1 * | 1/2002 | Silverbrook | 347/54 |
| 6,412,928 | B1 * | 7/2002 | Anagnostopoulos et al. | 347/77 |
| 7,255,425 | B2 * | 8/2007 | Lai et al. | 347/56 |
| 7,377,625 | B2 * | 5/2008 | Koyama et al. | 347/56 |
| 7,600,856 | B2 * | 10/2009 | Lebens et al. | 347/56 |
| 7,836,600 | B2 * | 11/2010 | Chwalek et al. | 29/890.1 |
| 7,881,594 | B2 * | 2/2011 | Fang et al. | 392/485 |
| 2002/0085070 | A1 * | 7/2002 | Anagnostopoulos et al. | 347/77 |
| 2006/0119662 | A1 * | 6/2006 | Lai et al. | 347/44 |
| 2006/0209134 | A1 * | 9/2006 | Silverbrook et al. | 347/63 |
| 2006/0238573 | A1 * | 10/2006 | Hu et al. | 347/54 |
| 2007/0034598 | A1 * | 2/2007 | Silverbrook et al. | 216/27 |
| 2007/0081032 | A1 * | 4/2007 | Silverbrook | 347/56 |
| 2007/0081038 | A1 * | 4/2007 | Worsman et al. | 347/61 |
| 2007/0153060 | A1 * | 7/2007 | Chwalek et al. | 347/54 |
| 2008/0121615 | A1 * | 5/2008 | Silverbrook et al. | 216/27 |
| 2009/0169190 | A1 * | 7/2009 | Fang et al. | 392/485 |
| 2010/0149279 | A1 * | 6/2010 | Silverbrook et al. | 347/61 |
| 2010/0163116 | A1 | 7/2010 | Fang et al. | |
| 2010/0163517 | A1 * | 7/2010 | Wang et al. | 216/11 |
| 2010/0167497 | A1 * | 7/2010 | Fang et al. | 438/443 |
| 2010/0171795 | A1 * | 7/2010 | Silverbrook et al. | 347/62 |

* cited by examiner

*Primary Examiner* — Allan Olsen
(74) *Attorney, Agent, or Firm* — Lisa K. Jorgenson; Hayley J. Stevens; Seed IP Law Group PLLC

(57) ABSTRACT

A method includes forming a recess in a first surface of a substrate, the recess having a width, depth, and height selected to correspond to a width, depth, and height of a fluid chamber, forming a sacrificial material in the recess, forming a first heater element, forming a metal layer overlying the first heater element, and forming a nozzle opening in the metal layer to expose the sacrificial material. The method also includes forming a path from a second surface of the substrate to expose the sacrificial material and removing the sacrificial material from the recess to expose the chamber with the selected width, depth, and height, the chamber in fluid communication with the path, the nozzle opening, and a surrounding environment.

19 Claims, 6 Drawing Sheets

METHOD TO FORM A RECESS FOR A MICROFLUIDIC DEVICE

BACKGROUND

1. Technical Field

The present disclosure relates to fluid chambers for microfluidic and micromechanical applications, and more particularly, to formation of fluid chambers with particular dimensions.

2. Description of the Related Art

In applications using microfluidic structures or micro-electro mechanical structures (MEMS), fluid is often held in a chamber where it is heated. The most common application is inkjet printer heads. Other applications include analyzing enzymes and proteins, biological examinations, and amplifying DNA. Some of these applications require processing fluids at specific temperatures and require accurate regulation.

For example, a DNA amplification process (PCR, i.e., Polymerase Chain Reaction) requires accurate temperature control, including repeated specific thermal cycles. Often, only very small amounts of fluid are used, either because of a small sample or the expense of the fluid. Reliable and predictable chamber shapes are important to accurately heat the liquid in the chambers.

Inkjet technology relies on placing a small amount of ink within an ink chamber, rapidly heating the ink, and ejecting it to provide an ink drop at a selected location on an adjacent surface, such as a sheet of paper. Currently, formation of the ink chamber includes forming a sacrificial oxide on a wafer, forming heater components, and forming a nozzle opening. The sacrificial oxide is approximately one micron thick and 200 microns wide. After formation of these components, a first potassium hydroxide (KOH) etch forms a manifold in a backside of the wafer. Subsequently, the sacrificial oxide is removed by a hydrogen fluoride (HF) etch. Then a second KOH etch is used to enlarge the cavity to form the desired ink chamber to the desired size.

The final size of the chamber is not precise due to the imperfections of the second KOH etch. The chamber profile relies completely on the second KOH etch. To get uniform etch inside the whole cavity requires a very stringent process control, i.e., a long etch time at a stable temperature and chemical concentration. In addition, during the second KOH etch, a fresh chemical supply and exchange of by products are passed through the opening of the manifold from the backside. In order to have good chemical transport, the opening must be large enough, i.e., approximately 1000 microns in diameter. This large size causes the wafer to be porous and fragile, which makes it difficult to handle.

It is critical to know the size and profile of the chamber in order to optimize performance of the structure. Currently, there is no available inline method to inspect and measure the chamber size and profile.

BRIEF SUMMARY

The present disclosure describes a method of forming a chamber having particular dimensions for substrates and MEMS that handle and process fluid. The method includes forming a recess in a first surface of a substrate, the recess having a width, depth, and height selected to correspond to a width, depth, and height of the chamber. The chamber is formed in an integrated circuit, which contains an inlet path for fluid and a nozzle (an exit path). The fluid is of the type that needs to be heated to selected temperatures for a desired purpose, for example, an inkjet printer, DNA amplification, or chemical analysis.

The method also includes forming a sacrificial material in the recess before formation of the nozzle and path. In one embodiment, the sacrificial layer may be 20 microns in depth. A heater element and a control circuit, which are coupled together and generate heat in the chamber, are also formed. The heater element may be formed prior to depositing the sacrificial material or subsequent to depositing the sacrificial material. The method also includes removing the sacrificial material from the recess to expose the chamber with the selected width, depth, and height, the chamber in fluid communication with the path, the nozzle, and a surrounding environment.

Formation of the chamber with precise dimensions provides the advantage of more control over the system, increases yield, and increases throughput. In addition, this method eliminates the second KOH step necessary to form the chamber in the prior art.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings.

DETAILED DESCRIPTION

Figure 1:
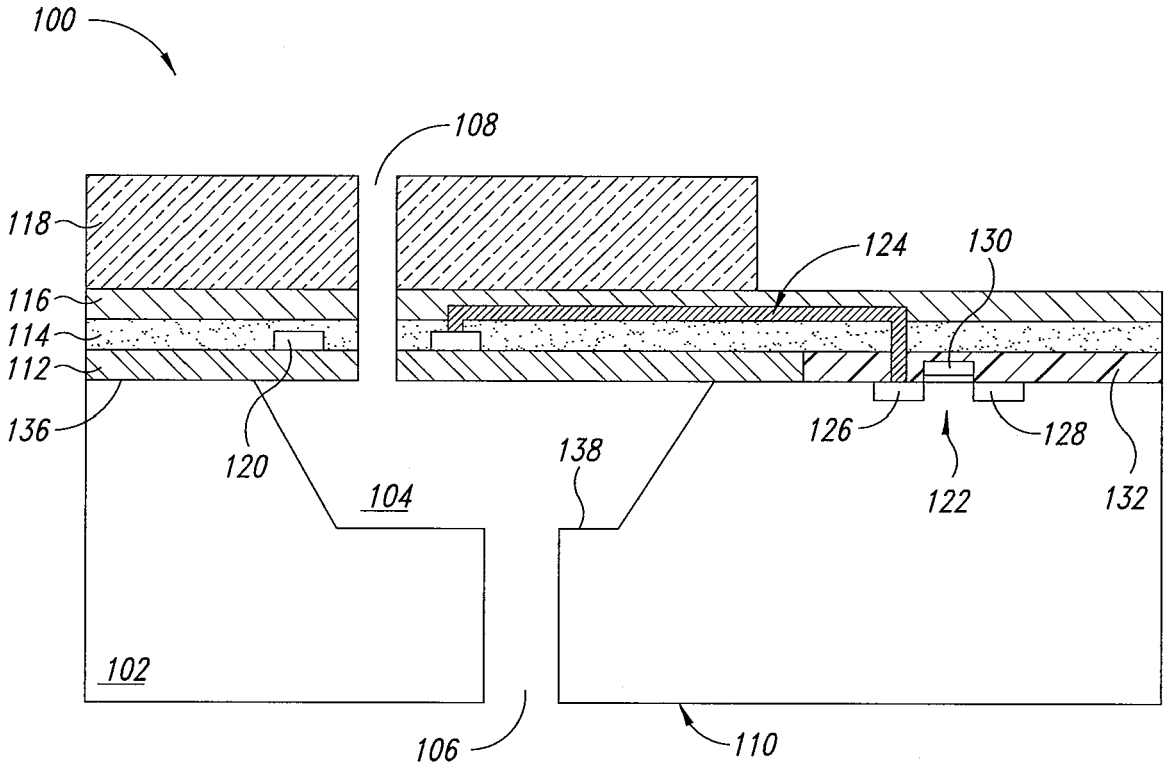
FIG. 1 is a schematic cross-section of a heat responsive chamber assembly according to one embodiment of the present disclosure.

In the following description, certain specific details are set forth in order to provide a thorough understanding of various embodiments of the disclosure. However, one skilled in the art will understand that the disclosure may be practiced without these specific details. In other instances, well-known structures associated with electronic components and semiconductor fabrication have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

In the drawings, identical reference numbers identify similar elements or acts. The size and relative positions of elements in the drawings are not necessarily drawn to scale.

Referring to FIG. 1, a microfluidic chamber assembly 100 is illustrated. Generally, microfluidic structures receive fluids from off the chip for on-chip handling of small volumes of liquid. One common use of such systems is inkjet printer heads.

The chamber assembly 100 includes a chamber 104 having selected dimensions formed in a substrate 102. In one embodiment, the chamber 104 has a depth of 20 microns from an upper surface 136 of the substrate 102 to a bottom 138. The chamber 104 is in fluid communication with an inlet path 106, a nozzle opening 108, and a surrounding environment. The formation of the chamber 104 occurs prior to fabrication of the inlet path 106, the nozzle opening 108, and other components of the assembly 100.

Controlling the dimensions of chamber 104 is advantageous for structures that process and handle fluids of different viscosities. Some fluids have a viscosity which makes it difficult for them to flow smoothly into small orifices or into small channels, such as nozzle 108. In addition to reducing process time and increasing yield, forming chambers with particular dimensions allows for optimization of chamber performance. Knowledge of the exact chamber size before formation of the heater elements allows a manufacturer to select the size and arrangement of the heater elements necessary to achieve the desired result. Specific details of the chamber formation will be discussed in more detail below with respect to FIG. 2.

The chamber 104 receives fluid through the inlet path 106 from a back surface 110 of the substrate 102. The nozzle opening 108 passes through a first insulation layer 112, an inter dielectric layer 114, a passivation layer 116, and a metal layer 118. A heater element 120 resides adjacent the nozzle opening 108 to heat the fluid for ejection into the surrounding environment. In another embodiment, another heater element is positioned beneath the chamber 104 (see FIGS. 12 and 15).

A transistor 122 couples to the heater element 120 through a metal interconnect 124. The transistor 122 may be any suitable switching device to provide electrical current to the heater element 120, such as a metal oxide semiconductor field effect transistor (MOSFET). The interconnect 124 couples to a source region 126 of the transistor 122. A drain region 128 and a gate electrode 130 of the transistor couple to other metal interconnects, which are not visible in this cross-section. A pre-metal dielectric layer 132 covers the transistor 122.

FIGS. 2-9 illustrate a series of process steps to form the chamber assembly in FIG. 1, according to one embodiment of the present disclosure. In this embodiment, the chamber 104 is formed in separate process steps from the electronic components, i.e., transistor 122.

The substrate 102 is monocrystalline semiconductor material, for example silicon. The substrate 102 can be doped with a desired conductivity type, either P-type or N-type. In one embodiment, the substrate 102 is 680 microns thick.

Figure 2:
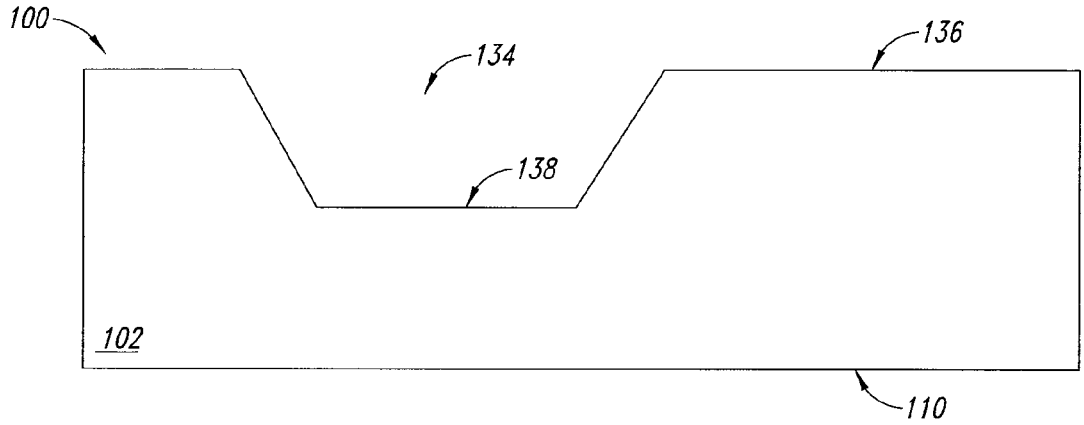
FIGS. 2-9 are schematics of the heat responsive chamber assembly of FIG. 1 at different stages in a manufacturing process.

As seen in FIG. 2, a recess 134 with a specific set of selected dimensions is formed in an upper surface 136 of the substrate 102 by etching or other acceptable technique. Known etching techniques, including wet etching, dry etching, or a combination of wet and dry etching, are controllable and suitable for etching particular shapes of recess 134. For example, a plasma etch technique can create straight sidewalls and a chemical wet etch technique can create sidewalls with a particular angle. Examples of wet etching methods include anisotropic and isotropic etching and examples of dry etching include reactive ion etching (RIE), deep reactive ion etching (DRIE), sputter etching, and vapor phase etching.

The dimensions of the recess 134 correspond to desired final dimensions of the chamber 104. Recess 134 may have a trapezoidal shape with a somewhat larger area at the upper portion than the bottom portion. The recess 134 has lower surface 138 that is a specific selected distance from the upper surface 136 of the substrate 102. In one embodiment, the lower surface 138 is at least 20 microns below the upper surface 136. The particular dimensions are selected prior to formation of recess 134 to meet design and performance specifications for the final device. The recess 134 may be any shape suitable for the design needs of the ultimate device. Other recess shapes will be discussed in more detail below (see FIGS. 10-13).

In the example of an inkjet printer, the size and profile of an ink chamber is critical to optimize printer performance. The chamber size corresponds to the amount of fluid heated and ejected onto the printing surface. Uniform chamber shape in a print head produces uniform ink ejection and, therefore, enhances print quality. In addition, the heater element's position and performance characteristics depend on the size and profile of the chamber.

In the example of DNA amplification, the chamber size is directly correlated to selected temperature control of fluids. At some stages, the fluid needs to be well above room temperature to amplify the DNA, while it cannot exceed the temperature at which the fluid becomes denatured. In addition, some DNA amplification applications require a uniform temperature throughout the entire fluid. A precise chamber size with selective heater placement allows for more uniform temperature control.

After etching, the recess 134 can be inspected to determine if the size and shape are compatible with the profile of the desired final chamber 104. If the dimensions are not correct, the chamber shape may be reworked before any other process steps are commenced. For example, if the recess 134 is underetched a subsequent etch could be executed to acquire the desired final chamber shape 104. This process allows for early detection of imperfections in the chamber shape instead of after formation of the electronic components, the inlet path 106, and the outlet path 108. The inspection also provides feedback for subsequent process steps on the wafers.

Figure 3:
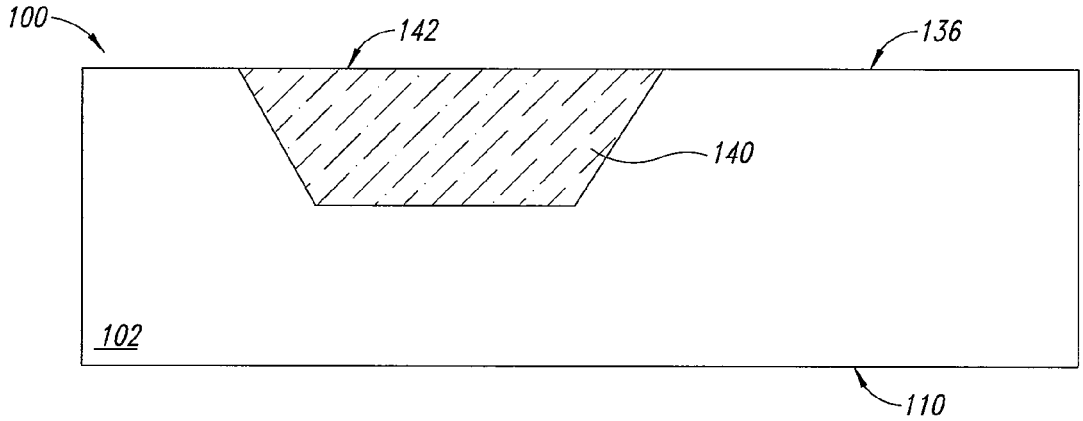

In FIG. 3, a sacrificial material 140 is deposited into the recess 134 in the substrate 102. This will be later removed at a subsequent process step to open the chamber 104. The sacrificial material 140 can be any material which can withstand subsequent process steps for formation of the integrated circuit (IC) components and can be removed from the recess after formation of the IC components. Preferably, the sacrificial material 140 has a low melting temperature so that the material 140 fills the cracks and corners of the recess evenly. Some examples of the sacrificial material include oxides, tetra ethyl ortho silicate (TEOS), borophosphosilicate glass (BPSG), or spin-on glass.

An upper surface 142 of the sacrificial material 140 may be processed to make the upper surface 142 coplanar with the upper surface 136 of the substrate 102. This may be achieved by a chemical mechanical planarization (CMP) technique or other technique suitable to planarize the sacrificial material 140.

Figure 4:
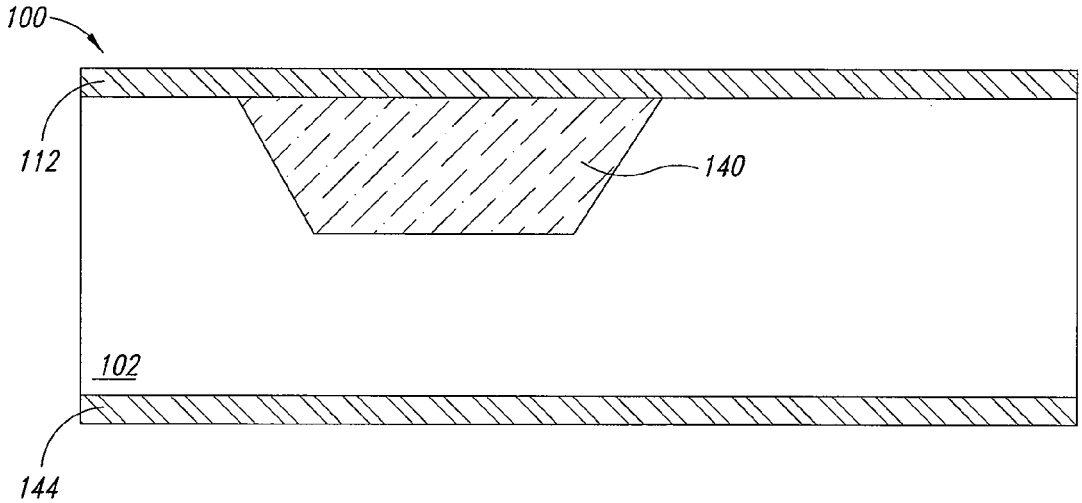

As shown in FIG. 4, the insulation layer 112 is formed, either by growth or deposition, over the sacrificial material 140 and the upper surface 136 of the substrate 102. The insulation layer 112 can be a combination of layers, such as a pad oxide layer and a nitride layer or equivalent layer. The pad oxide layer is first deposited over the upper surface 136 of the substrate 102 and the upper surface 142 of the sacrificial material 140 as protection for the underlying materials. The pad oxide may be in the range of 20 to 100 Angstroms thick. The pad oxide is then covered by the nitride layer, which may have a thickness in the range of 50 to 3,000 Angstroms. The nitride layer may also be deposited in layers, which can include a layer of low-stress nitride. The insulation layer 112 thus may include an oxide directly on the silicon and a nitride deposited on top of the oxide, the nitride being 2 to 30 times thicker than the oxide.

Instead of a deposition technique, in some embodiments the insulation layer 112 can be grown on the upper surface 136 of the substrate 102. The insulation layer 112 electrically isolates the upper surface 136 of the substrate 102 from the other components.

A backside insulation layer 144 is deposited on the back surface 110 of the substrate 102 as a protection layer for subsequent process steps. The backside insulation layer 144 may be formed of the same low-stress nitride as the insulation layer 112 on the upper surface 136 of the substrate 102 or the insulation layer 144 may be grown. The application of the insulation layer 112 and the backside insulation layer 144 can be in a batch process technique so that both layers evenly coat the wafer in one process.

Figure 5:
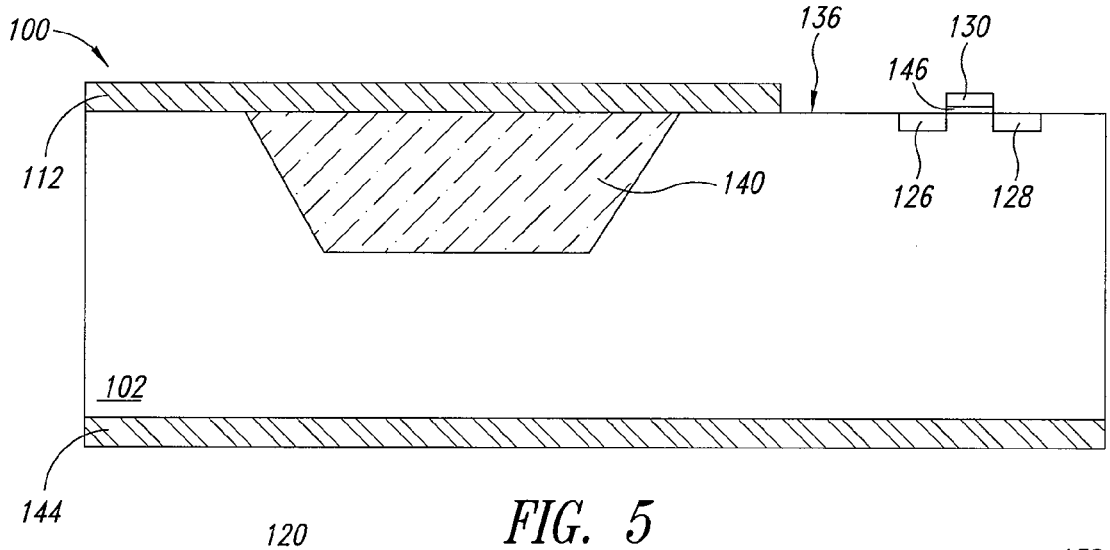

As shown in FIG. 5, the insulation layer 112 is etched to expose the upper surface 136 of the substrate 102 at a location spaced from the sacrificial material 140 in the recess 134. The IC components, illustrated as the transistor 122 with the source region 126, the drain region 128, and the gate electrode 130, are fabricated using conventional IC process techniques that are well known and will not be described in detail. A thin dielectric layer 146 separates the gate electrode 130 from the substrate 102.

The dielectric layer 146 is formed on the upper surface 136 of the substrate 102, extending at least between the source region 126 and the drain region 128. The gate electrode 130 forms on the dielectric layer 146 for controlling current as will be discussed in more detail below with respect to electrical communication between the transistor 122 and the heater element 120. The dielectric layer 146 may include a silicon dioxide, a silicon nitride, a sandwich layer of silicon dioxide and silicon nitride, or some other combination of suitable dielectric material.

The gate electrode 130 can be any acceptable conductive material, such as polysilicon, polysilicon with a silicide layer, metal, or any other conductive layer that is compatible with the process of the present disclosure. The process technology and steps for forming such are known. The transistor can be of any suitable type, such as a MOSFET of LDMOS, VDMOS, etc.

Figure 6:
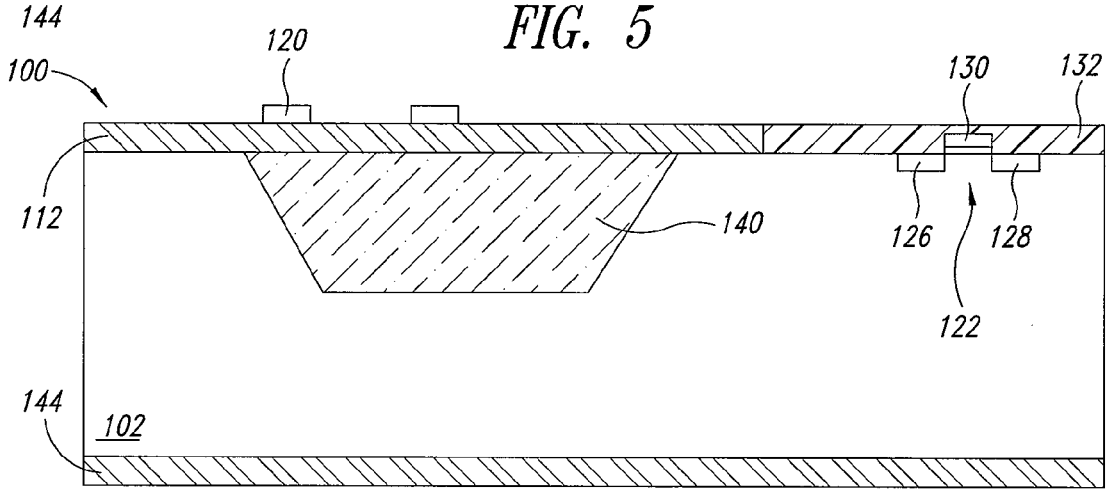

The pre-metal dielectric layer 132 covers the transistor 122, as shown in FIG. 6. After deposition, the insulation layer 112 and the pre-metal dielectric 132 may be planarized by CMP or other suitable technique. However, the heater element may be formed without planarizing the insulation layer 112 and the pre-metal dielectric layer 132.

The heater element 120 is formed by depositing and etching a layer of heater material on the insulation layer 112. The etching leaves behind only a portion of the heater element 120 aligned over the sacrificial material 140 in the recess 134. The position of the heater element 120 is above the chamber 104 and adjacent the location of the expected nozzle opening 108, as shown in FIG. 1. The nozzle opening 108 will be described in more detail below. In an alternative embodiment, the heater element 120 may be formed below the sacrificial material 140 in the recess 134 (see FIGS. 10 and 13).

The heater element 120 can include any suitable material for use with semiconductors that produces heat from electrical resistance. In some embodiments, it is preferable to use a resistive material that is also corrosion resistant. For example, in one embodiment, the heater element 120 includes Tantalum, such as Tantalum Aluminum (TaAl). In another embodiment, the heater element 120 is polysilicon, which can be deposited in the same process as the gate 130. If the gate 130 is doped, the polysilicon for the heater element 120 will not be doped, so that it is comprised of intrinsic polysilicon. Alternatively, the heater element 120 may have very light levels of dopant of P or N so as to slightly increase the resistance and improve the heater properties. The thickness of the heater element 120 may be a different thickness than the gate 130, since the purpose is to function as a heater rather than a highly conductive gate member. In such situations, even though both layers are poly, they may be deposited in separate steps.

In an alternative embodiment, the heater element 120 may be a high-temperature metallic heater such as an alloy that contains one or more of nickel, silver, or molybdenum, in various combinations. A metal oxide, ceramic oxide, or other sophisticated resistive metal heater element may also be used.

Figure 7:
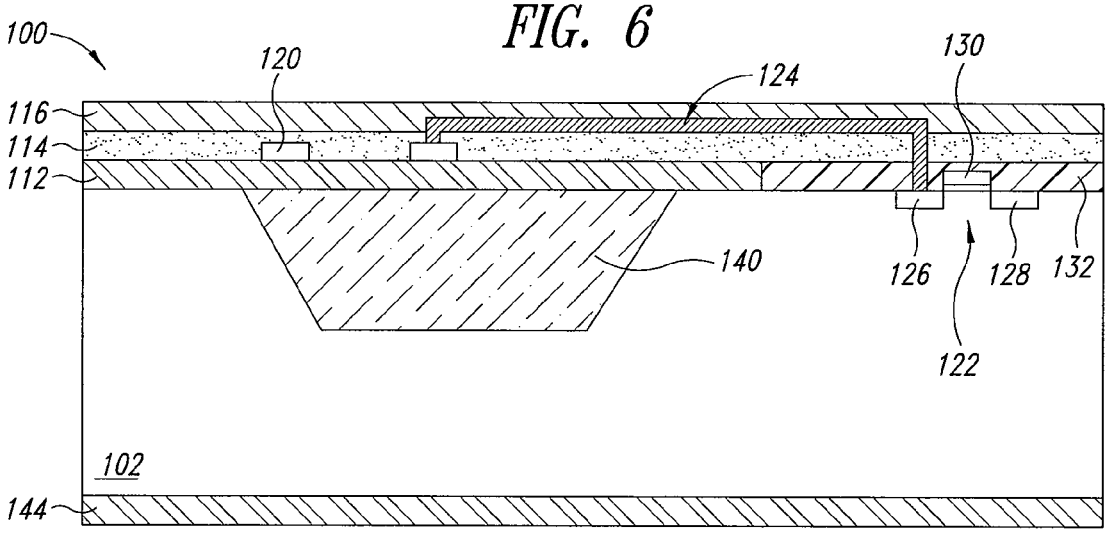

Electrical current from the transistor 122 is supplied to the heater element 120 through via and interconnect structure 124, as illustrated in FIG. 7. The inter dielectric layer 114 is deposited over the heater element 120, the insulation layer 112, and the pre-metal dielectric layer 132. The via is formed through the inter dielectric layer 114 and the pre-metal dielectric layer 132 to expose a portion of the source region 126 of transistor 122. The via can be formed by etching an opening in the insulating layers to expose the source region 126 to be connected. The opening can be filled with a conductive plug, such as tungsten, with a TiN liner, or filled with another acceptable conductor. This is followed by deposition of a conductive layer, such as a metal, for example doped aluminum, silicon doped copper, tungsten, or combinations thereof, followed by etching to create the interconnect structure 124. The interconnect structure 124 is selected to be of a material and size such that it will not significantly heat up while carrying the current to the heater element 120.

The process for forming the control circuitry, including the transistors, on the same substrate as heating chambers is well known in the art and the details will therefore not be described. Any of the many known and widely practiced techniques for forming the MOSFETs and other circuits on the substrate 102 with the chamber 104 may be used.

As illustrated in FIG. 7, passivation layer 116 is applied over the dielectric layer 114, and the interconnect structure 124. The passivation layer 116 may be a nitride, a phosphosilicate glass followed by a nitride, a stack of oxide-nitride-oxide, a stack of silicon-oxide-nitride, or other compatible inter-metal insulating layer. In one embodiment, the total height of layers 112, 114, and 116 is one micron. As compared to a chamber depth of 20 microns, the stack of layers is very small.

Figure 8:
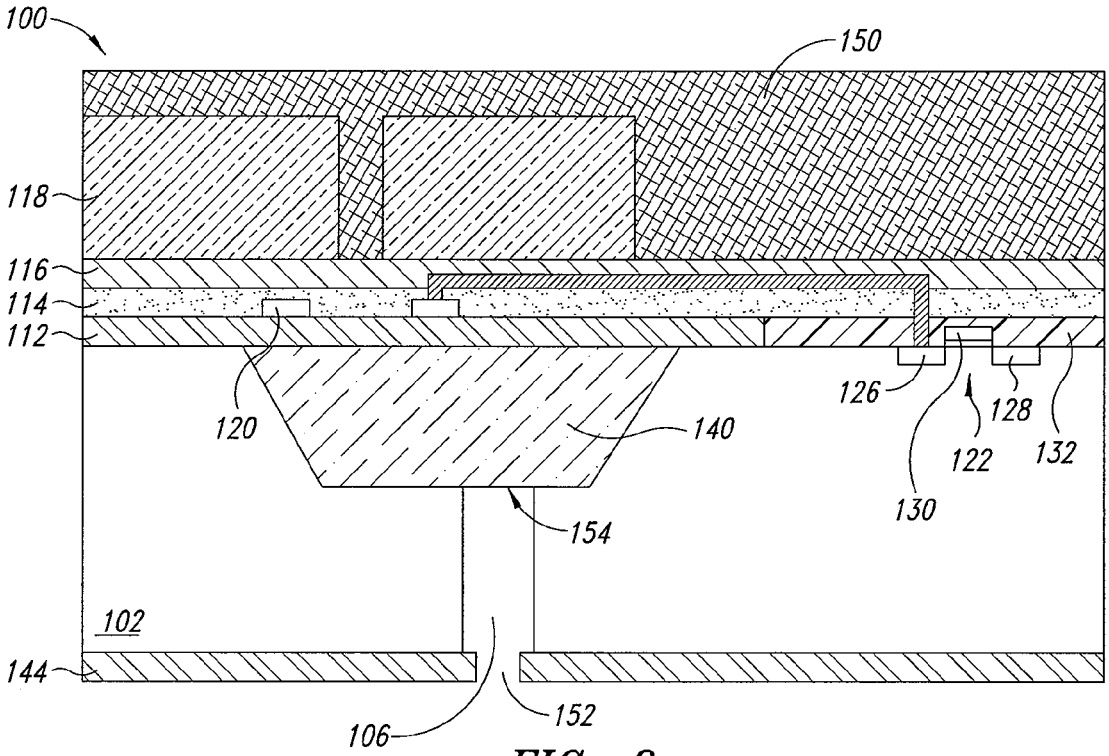
Figure 9:
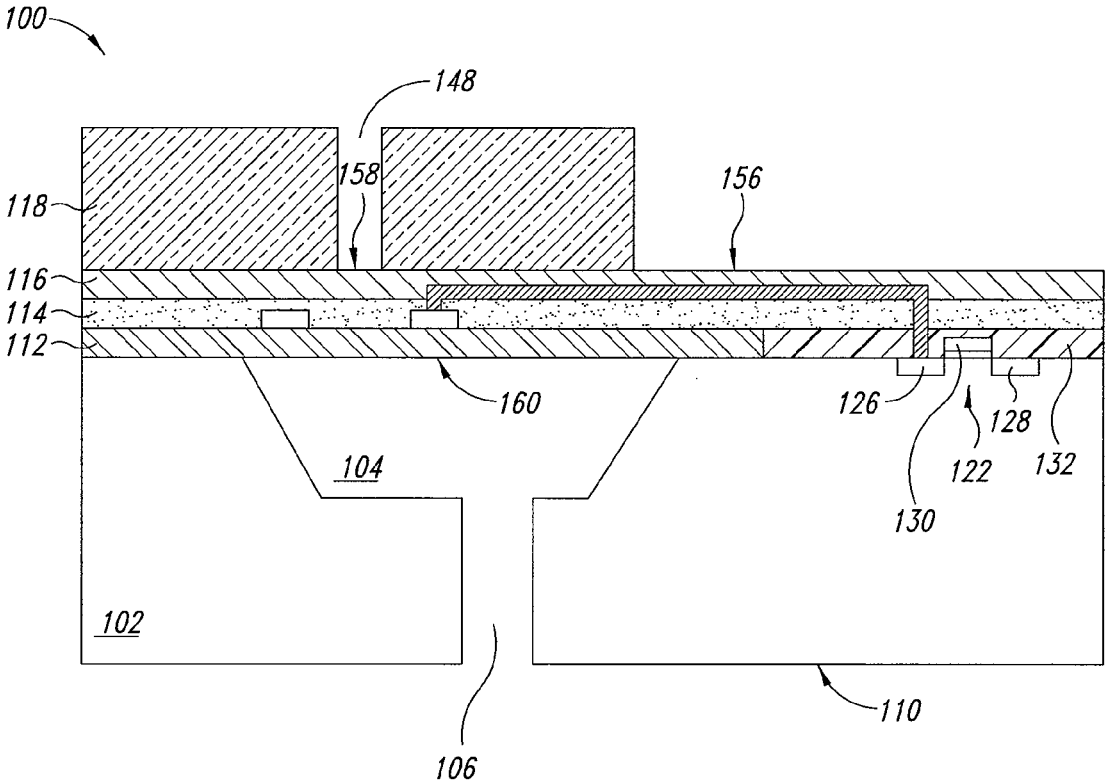

Subsequently, as shown in FIG. 8, metal layer 118 is deposited over passivation layer 116 and functions as a heat sink and provides the walls of the nozzle 108. Existing art devices are known to incorporate relatively large amounts of gold, such as 1.5 grams of gold per wafer. This is because these devices heat fluid from one location which is distal with respect to the location at which the fluid exits the device. Accordingly, in existing devices, extremely high temperatures, such as 800° C., are applied to the chamber 104 and fluid, which heats the entire surrounding region. This heat needs to be effectively absorbed to protect adjacent and external components, for example, other chambers, transistors, and components external to these heaters in inkjet printer heads.

In some embodiments, metal layer 118 is positioned to reduce or eliminate an impact of the heat being generated by the chamber assembly 100 on components externally located with respect to the chamber assembly 100. Typically, the metal layer 118 is a material that exhibits superior heat absorption and dissipation qualities. Such material is often selected from a group of metals, including gold, silver, tungsten, or copper.

Metal layer 118 may be formed by an electroplating technique or other suitable technique. A part 148 of the nozzle 108 forms overlying the sacrificial material 140 in the recess and is aligned along a central axis of heater element 120. Any nozzle and technique for forming the nozzle may be used. More particularly, the nozzle and heat sink structure of the chamber assembly 100 may be formed by various techniques and many configurations may be substituted for the nozzle 108 and metal layer 118 in FIG. 8. The ultimate size and shape of the nozzle 108 and the metal layer 118 depends on the desired performance of the final device.

A protection layer 150 is formed overlying the front side of the wafer, which fills the part 148 of the nozzle 108 and covers metal layer 118. The protection layer 150 is deposited before the path 106 is formed in the substrate 102 and before the sacrificial material 140 is released from the recess 134. In an alternative embodiment, the final nozzle opening 108 may be formed prior to or simultaneously with the formation of the path 106 in the substrate 102.

After deposition of the protection layer 150 the backside insulation layer 144 is masked and etched to form an opening 152 to expose the back surface 110 of the substrate 102. The opening 152 indicates the location where the path 106 through the substrate 102 will be formed. The opening 152 is positioned at a location below the sacrificial material 140, so that in a subsequent step a bottom surface 154 of the sacrificial material 140 will be exposed by the path 106.

The path 106 through the substrate 102 that exposes the bottom surface 154 of the sacrificial material 140 is formed by etching the substrate 102 through the opening 152 in insulation layer 144. The path 106 has vertical sidewalls; however, other angled sidewalls are acceptable using known techniques in the art (see FIG. 13).

The path 106 is formed using known methods, which include etching steps, such as dry etching, wet etching, layer formation, deposition, lithography, potassium hydroxide etching, or a combination thereof. In one embodiment, a potassium hydroxide (KOH) etch is used to form the path 106. The path 106 can ultimately have vertical sidewalls since a second KOH etch is not required to form the final chamber shape. The protection layer 150 and the insulation layer 144 are formed of materials which are not affected by the KOH etch.

Subsequently, the protection layer 150 is removed from the upper surface 156 of the passivation layer 116, the metal layer 118, and from the part 148 of the nozzle 108. The removal of the protection layer 150 re-exposes a portion 158 of the passivation layer 116 exposed by the part 148 of the nozzle 108. The insulation layer 144 is also removed from the back side of the substrate 102 to re-expose the back surface 110 of the substrate 102. The removal of the insulation layer 144 may be prior to removal of the passivation layer 150 or subsequent to removal of the passivation layer 150. In addition, the process may be executed simultaneously or concurrently.

After removal of the passivation layer 150 and the insulation layer 144, the sacrificial material 140 is removed from the recess 134. An etch technique is used to remove the sacrificial material 140. One technique which may be utilized, is a hydrogen fluoride (HF) etch. The HF etch removes materials such as TEOS and BPSG, but does not significantly affect the substrate 102 or the metal layer 118. The removal of the sacrificial material 140 exposes a bottom surface 160 of the insulation layer 112.

The chamber 104, as discussed above, has a trapezoidal shape with a larger area at the upper portion than at the bottom portion. The chamber 104 may have other shapes as appropriate for the circumstances (see FIGS. 10-13). The shape corresponds exactly to the desired selected dimensions when the recess 134 has formed as set forth with respect to FIG. 2. Since the etching was performed on an open, exposed substrate, the desired shape can be more exactly formed than if the etching were done solely through path 106 or nozzle 108. This final chamber 104 shape and profile can be confirmed by inspection before the deposition of the various layers and before formation of the electronic components.

Forming the final nozzle 108 can occur simultaneously with the removal of the sacrificial material 140 during the HF etch. In an alternative embodiment, the final nozzle 108 may be formed prior to or concurrently with the removal of the sacrificial material 140.

Figure 10:
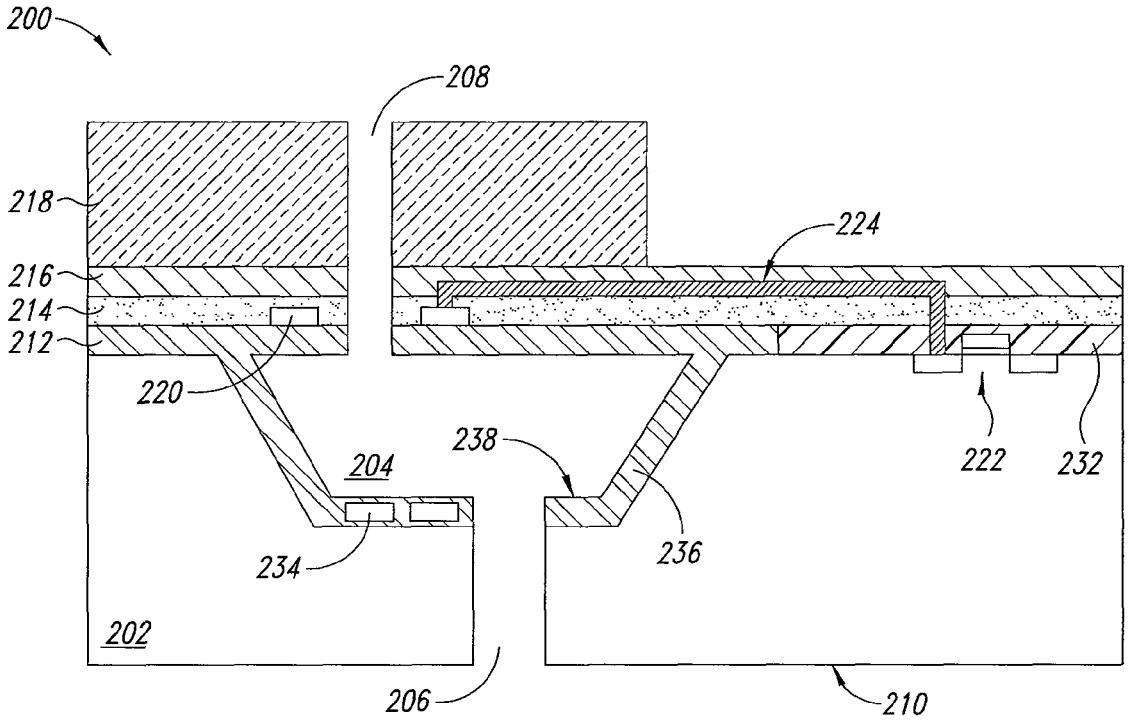
FIGS. 10-13 are alternative embodiments of the heat responsive chamber assembly of FIG. 1.

FIGS. 10-13 are alternative embodiments of the present disclosure with various chamber shapes and alternate locations for heater elements. Referring initially to FIG. 10, a chamber assembly 200 includes a chamber 204 formed in a substrate 202 with a heater element 234 formed below chamber 204. The chamber 204 can be the same trapezoidal shape described with respect to FIGS. 1-9 or a different shape. A recess, not shown, will be formed in the substrate 202 that corresponds to the final chamber shape 204.

Figure 13:
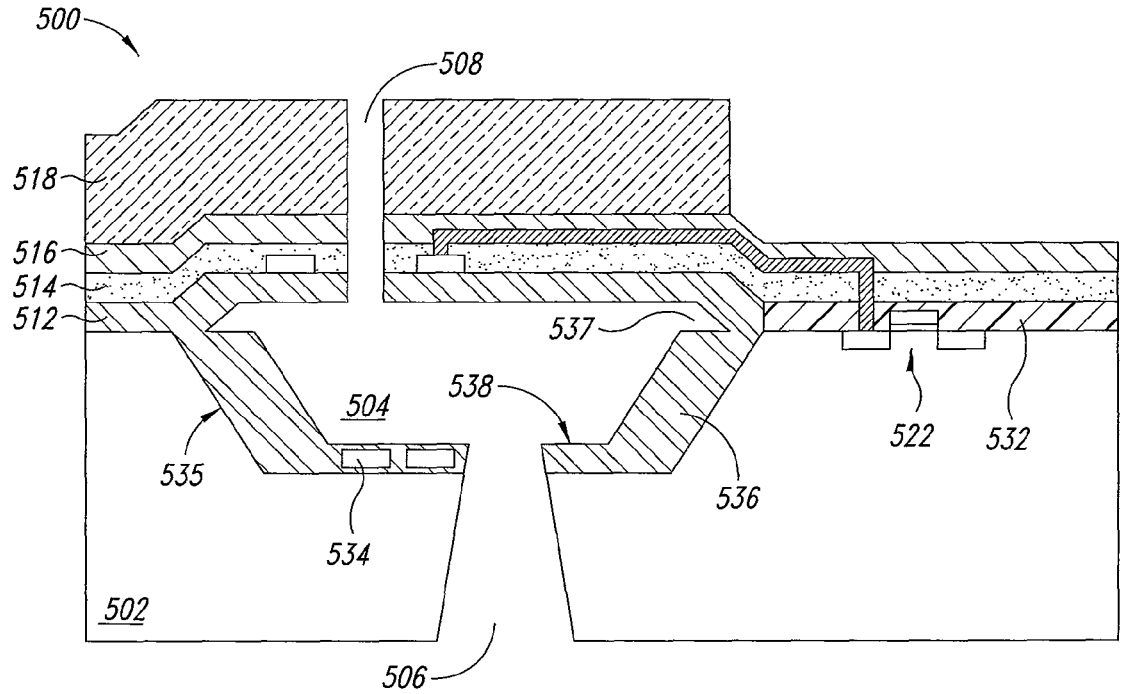

FIGS. 10 and 13 both have first heater element 234, 534 below the chamber 204, 504. Dielectric layer 236, 536 surrounds the first heater element 234, 534 along a bottom surface of the chamber 204, 504. The heater 234, 534 is formed by known techniques as discussed above. In one embodiment, the dielectric layer 236, 536 is conformally deposited over the first heater element 234, 534 and over an upper surface of the substrate 202, 502. The dielectric layer 236, 536 is deposited in a manner such that the profile of the recess is substantially preserved, for example a nitride is deposited substantially conformally. The dielectric layer 236, 536 covers the first heater element 234, 534 and provides a bottom surface 238, 538 of chamber 204, 504. The thickness of the heater element 234, 534 is smaller than the chamber depth.

The chamber 204, when initially formed, is made deeper and larger by an amount equal to what the layers 234 and 236 will add to the walls. Since it is known in advance that layers 234 and 236 will be added, the chamber 204, when it is etched, will be made larger by this amount than its final dimensions. Thus, when the layers 234 and 236 are added, the final chamber to be used in the end product will now be the desired final etched shape and size. Thus, the etched size and shape of chamber 104 or 204 corresponds to the desired final chamber size and shape, but may be different in the specific size and shape to accommodate later process steps, such as adding layers or etching.

The dielectric layer 236, 536 preferably includes a hard and durable material, which does not deteriorate despite its thickness and can be subjected to high temperatures. In one embodiment, the dielectric layer 236, 536 includes low-stress nitride, deposited using low-stress nitride deposition methods as are known in the art. Dielectric layer 236, 536 may also be carbide or other inert, hard material.

In another embodiment, the dielectric layer 236, 536 can be grown on the upper surface of the substrate 202, 502 and around the heater 234, 534. The dielectric layer 236, 536 electrically isolates the upper surface of the substrate 202, 502. It can be a material with desirable heat transfer properties to reduce heat from the first heater element 234, 534 and prevent the heat from spreading to substrate 202, 502 around the chamber 204, 504.

There are many acceptable techniques to couple the first heater element 234, 534 in the bottom of a chamber to a transistor that provides the heating current. Such connections are common in the prior art and any known technique that electrically couples the transistor to the heater element 234, 534 is acceptable. The connection and transistor are not visible in these cross sections.

Transistor 222, 522 provides current to a second heater element 220, 520 through interconnect 224, 524 and is formed in the same manner as the heater element 120 discussed above in FIGS. 1-9. In an alternate embodiment, the second heater element 220, 520 is optional.

In embodiments which have more than one heater element, as seen in FIGS. 10 and 13, the fluid in the chamber 204, 504 is heated by the first heater 234, 534 and by second heater elements 220, 520. The lower first heaters 234, 534 heat the fluid above a selected threshold, to heat the fluid entering the chamber 204, 504 from a manifold, or stored in the chamber 204, 504. The first heaters 234, 534 bias the fluid toward the nozzle opening 208, 508 and project the fluid out toward the surrounding environment. The second heater element 220, 520 positioned adjacent the nozzle opening 208, 508 can selectively generate heat above the threshold to facilitate movement of fluid through the nozzle opening 208, 508 away from the chamber 204, 504.

The first heater element 234, 534 can include any suitable shape that promotes consistent heating of the chamber 204, 504. For example, the first heater element can be in the form of a torus shape, a hollow cylindrical shape, a solid shape, a square, a rectangle, a star with an opening in the center, a plurality of fingers, or any other suitable shape. In the illustrated embodiment of FIGS. 10 and 13, the first heater element 234, 534 includes a square-edged torus shape.

Figure 11:
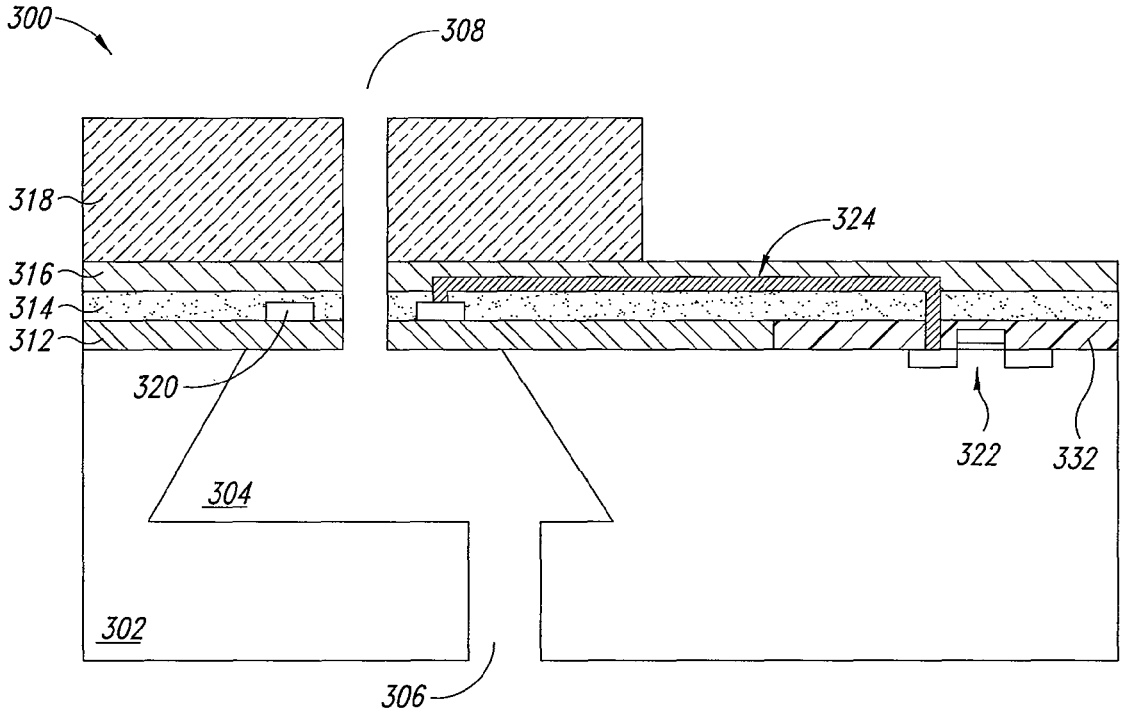
Figure 12:
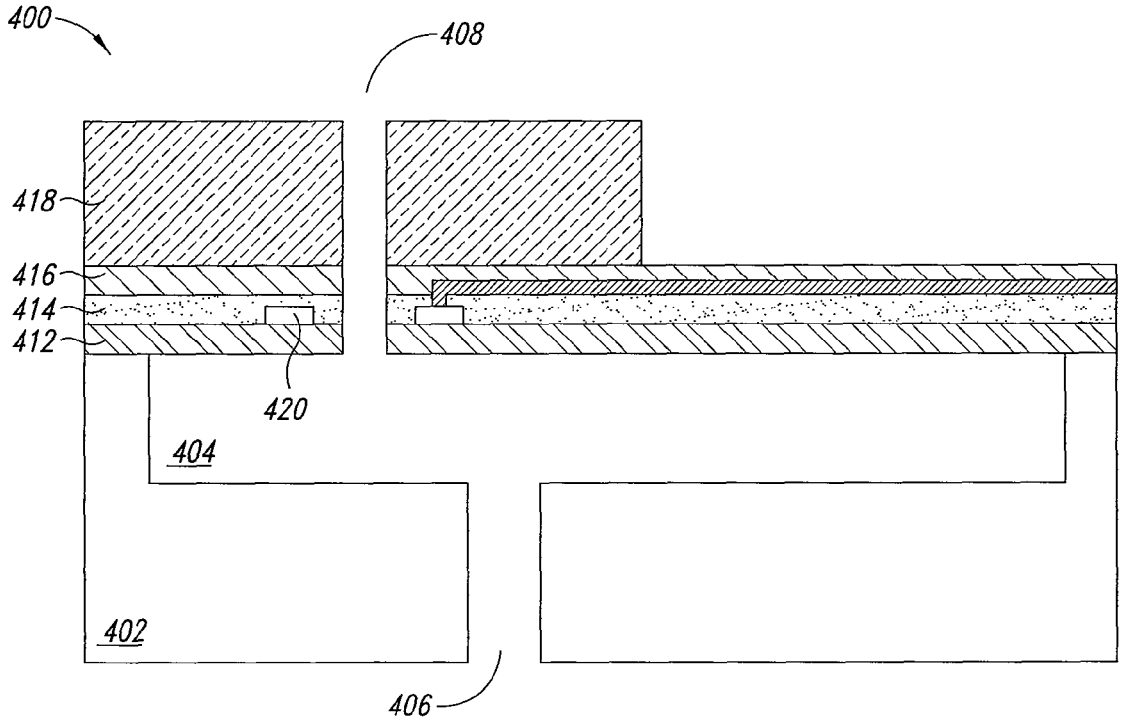

In FIG. 11 illustrates another embodiment having a chamber 304 formed to have a trapezoidal shape where a lower width is larger than an upper width. FIG. 12 illustrates yet another embodiment having chamber 404 with vertical sidewalls. Chambers 304 and 404 illustrate various chamber shapes that can be formed in accordance with the present disclosure. The chamber may be annular in shape or form a long tube with either cylindrical or curved sidewalls, a truncated cone, or other cone shape. The embodiment of the long tube or cone may be particularly beneficial for DNA amplification and other biological uses. In other embodiments, the chamber is in the form of a prism, which may include various geometrical prism shapes, such as a cuboid, a right prism, an oblique prism, or other acceptable shapes depending on the particular fluids and the particular uses.

FIG. 13 illustrates the alternate chamber 504, formed in accordance with another embodiment of the present disclosure. The chamber 504 is formed by etching a recess 535 in the substrate 502 with exact dimensions that correspond to final desired chamber 504 dimensions. The dielectric layer 536 is deposited conformally over heater element 534 at a known thickness to substantially maintain the desired chamber 504 shape. Subsequently, a mask and deposition sequence fills the remaining recess 535 with a sacrificial material (not shown) and forms a pointed overhang 537 on each side of the chamber 504. A nozzle 508 and the surrounding layers are formed in accordance with the process described above with respect to FIGS. 1-9.

Path 506 illustrates an alternative path shape with angled sidewalls, as is common in the prior art. Manufacturers can select the path shape to meet the needs of the device.

These examples are provided to demonstrate that many precise chamber shapes are achievable and fall within the scope of the claims that follow. Various modifications and combinations of the component arrangements shown herein can be made that fall within the scope of the invention. For example, the path 506 through the substrate as shown in FIG. 13 can be a variety of shapes. Also, the heater elements' arrangement, size, and number may be combined in various modifications.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of forming a fluid chamber and source and drain regions of a transistor in a substrate, the forming comprising:

forming a recess in a first surface of the substrate prior to forming the source and drain regions of the transistor in the first surface of the substrate, the recess having a width, depth, and height selected to correspond to a width, depth, and height of the fluid chamber;

forming a sacrificial material in the recess;

forming the source and drain regions of the transistor in the substrate;

forming a nozzle structure overlying the sacrificial material having a nozzle opening that exposes the sacrificial material;

forming a path from a second surface of the substrate to expose the sacrificial material; and removing the sacrificial material from the recess to expose the chamber with the selected width, depth, and height, the chamber in fluid communication with the path, the nozzle opening, and a surrounding environment.

2. The method of claim 1, further comprising:

forming a passivation layer on the sacrificial material in the recess;

forming the source and drain regions of the transistor in a portion of the substrate not covered by the passivation layer;

forming a conductive heater element on the passivation layer prior to forming the nozzle structure; and coupling the heater element to the transistor.

3. The method of claim 1, further comprising etching the sacrificial material until the sacrificial material is coplanar with the first surface of the substrate.

4. The method of claim 1, further comprising forming a heater element in the recess of the substrate prior to forming the sacrificial material in the recess.

5. The method of claim 4, further comprising selecting the width, depth, and height of the recess to account for dimensions of the heater element.

6. A method, comprising:

forming a recess in a first surface of a substrate, the recess having a width, depth, and height selected to correspond to a width, depth, and height of a fluid chamber;

forming a sacrificial material in the recess;

forming a dielectric layer overlying the sacrificial material;

forming a first heater element in the dielectric layer;

forming a metal layer overlying the dielectric layer;

forming a nozzle opening in the metal layer and the dielectric layer to expose the sacrificial material, the first heater element being adjacent to the nozzle opening in the dielectric layer;

forming a path from a second surface of the substrate to expose the sacrificial material; and removing the sacrificial material from the recess to expose the chamber with the selected width, depth, and height, the chamber in fluid communication with the path, the nozzle opening, and a surrounding environment.

7. The method of claim 6, further comprising etching the sacrificial material until the sacrificial material is coplanar with the first surface of the substrate.

8. The method of claim 6 wherein final chamber dimensions are the exact selected width, depth, and height of the chamber.

9. The method of claim 6 wherein mutually opposing walls of the path are formed at a preselected angle from vertical.

10. The method of claim 6, further comprising forming the first heater element of a material with an electrical resistance, the material generating heat when subjected to an electrical current to heat fluid in the chamber to a target value.

11. The method of claim 10, further comprising forming a control element coupled to the first heater element to provide the electrical current.

12. The method of claim 10, further comprising positioning a second heater element between the chamber and the substrate.

13. The method of claim 12, further comprising selecting the width, depth, and height of the recess to account for dimensions of the second heater element.

14. A method, comprising:

forming a recess in a substrate, the recess having a selected width, depth, and height;

forming a heater element adjacent to a bottom surface of the recess;

forming a sacrificial material in the recess, the sacrificial material defining a chamber with a selected width, depth, and height that corresponds to the selected width, depth, and height of the recess;

forming a metal layer overlying the sacrificial material;

forming a nozzle opening in the metal layer to expose the sacrificial material;

forming a path in the substrate to expose the sacrificial material in the recess; and removing the sacrificial material from the recess to expose the chamber with the selected width, depth, and height, the chamber being in fluid communication with the path, the nozzle opening, and a surrounding environment.

15. The method of claim 14, further comprising processing the sacrificial material until the sacrificial material is coplanar with the substrate.

16. The method of claim 14 wherein final chamber dimensions are the exact selected width, depth, and height of the chamber.

17. The method of claim 14 wherein mutually opposing walls of the path are formed at a preselected angle from vertical.

18. The method of claim 14, further comprising forming the heater element from a material having an electrical resistance and configured to generate heat when subjected to an electrical current to heat fluid in the chamber to a target value.

19. The method of claim 18, further comprising forming a control circuit adjacent to the recess and coupled to the heater element, the control circuit configured to control the electrical current for the heater element.

* * * * *